US011278770B1

(12) United States Patent
Tuber et al.

(10) Patent No.: US 11,278,770 B1
(45) Date of Patent: Mar. 22, 2022

(54) CONFIGURABLE GOLF PUTTER HEAD ASSEMBLY

(71) Applicants: Anthony Tuber, Hamburg, NY (US); Michael Tuber, Hamburg, NY (US)

(72) Inventors: Anthony Tuber, Hamburg, NY (US); Michael Tuber, Hamburg, NY (US)

( * ) Notice: Subject to any disclaimer, the term of this patent is extended or adjusted under 35 U.S.C. 154(b) by 0 days.

(21) Appl. No.: 17/144,621

(22) Filed: Jan. 8, 2021

(51) Int. Cl.
*A63B 53/06* (2015.01)
*A63B 53/02* (2015.01)
*A63B 53/00* (2015.01)

(52) U.S. Cl.
CPC ..... *A63B 53/02* (2013.01); *A63B 53/007* (2013.01)

(58) Field of Classification Search
CPC ..... A63B 53/02; A63B 53/007
See application file for complete search history.

(56) References Cited

U.S. PATENT DOCUMENTS 4,736,951 A * 4/1988 Grant ..... A63B 53/007 473/246
5,137,275 A * 8/1992 Nelson ..... A63B 53/0487 473/306
5,160,141 A 11/1992 Crews
5,470,063 A 11/1995 Fisher
6,213,889 B1 * 4/2001 Hamburger ..... A63B 60/00 473/245
6,623,372 B1 * 9/2003 Beebe ..... A63B 53/02 473/231
7,077,760 B2 * 7/2006 Gray ..... A63B 53/007 473/313
7,201,668 B1 4/2007 Pamia
9,375,616 B2 6/2016 Zimmerman et al.
9,403,066 B2 * 8/2016 Esposito ..... A63B 53/0487
9,981,170 B2 * 5/2018 Myers ..... A63B 53/02
10,328,317 B2 * 6/2019 Wang ..... A63B 71/06
10,518,139 B2 * 12/2019 Jones ..... A63B 53/007
10,716,972 B1 * 7/2020 Holtzman ..... A63B 53/02
2002/0010033 A1 * 1/2002 Aoki ..... A63B 60/42 473/219

(Continued)

FOREIGN PATENT DOCUMENTS

JP 3137705 U 11/2007
JP 2008307100 A 12/2008

(Continued)

*Primary Examiner* — Stephen L Blau
(74) *Attorney, Agent, or Firm* — Walter W. Duft

(57) ABSTRACT

A golf putter head assembly includes a putter head and a two-part hosel detachably mounted to the putter head by a single removable fastener. The two-part hosel includes a lower intermediate connector extending upwardly from the putter head, and an upper shaft connector extending upwardly from the intermediate connector. The fastener extends through a crown-to-sole through-bore formed in the putter head, through a longitudinal through-bore formed in the intermediate connector, and into a blind bore formed in a lower member of the shaft connector. An upper member of the shaft connector is mountable to a putter shaft. The upper member is angled relative to the lower member to define a shaft-head lie angle, and is offset from the lower member to define a shaft-head offset distance. The intermediate connector has a selected length that establishes a shaft-head balance characteristic. A kit and a method are also disclosed.

20 Claims, 11 Drawing Sheets

(56) References Cited

U.S. PATENT DOCUMENTS

| | | | | |
|---|---|---|---|---|
| 2002/0198060 | A1* | 12/2002 | Fisher | A63B 60/00 473/244 |
| 2011/0009207 | A1* | 1/2011 | Jansson | A63B 53/007 473/307 |
| 2012/0190474 | A1 | 7/2012 | Sato | |
| 2017/0296882 | A1* | 10/2017 | Burch | A63B 53/02 |
| 2018/0229086 | A1* | 8/2018 | Jo | A63B 53/02 |
| 2019/0091530 | A1* | 3/2019 | Li | A63B 53/02 |
| 2019/0175996 | A1* | 6/2019 | Kroloff | A63B 53/0487 |
| 2020/0179770 | A1 | 6/2020 | Lapuz | |
| 2020/0197768 | A1* | 6/2020 | Woodward | A63B 60/02 |
| 2020/0282267 | A1* | 9/2020 | Hamburger | A63B 53/02 |

FOREIGN PATENT DOCUMENTS

| | | | |
|---|---|---|---|
| JP | 2014217514 | A | 11/2014 |
| JP | 2015173666 | A | 10/2015 |
| WO | WO200687846 | A1 | 8/2006 |

* cited by examiner

CONFIGURABLE GOLF PUTTER HEAD ASSEMBLY

BACKGROUND

1. Field of the Disclosure

The present disclosure relates to equipment used to play the game of golf. More particularly, the disclosure concerns golf clubs, and in particular golf putters, and still more particularly putter head assemblies.

2. Description of the Prior Art

By way of background, golf putters typically include a putter head and hosel mounted to a shaft that extends upwardly to a grip. Many golf putters are manufactured in monolithic fashion, with the head assembly components and shaft permanently connected together. When selecting a putter for purchase, the player must ensure that the putter head is the right style, the head balance is to their liking, the lie angle is correctly matched to the player's height and putting stance, and the head to shaft offset distance (in the putting stroke direction) is consistent with the player's putting style. A typical player may thus have to sample many different putters before finding the "right one." This requires that pro shops and retail golf equipment vendors maintain a large number of putters in their inventories, which ties up monetary resources. A further disadvantage of monolithic putters is that the entire club must usually be replaced whenever any of the component parts becomes damaged.

Efforts have been made to produce configurable putters in which one or more components of the putter can be assembled together in different ways to provide a variety of putter configurations. A drawback of many configurable putters is that they do not provide a suitable number of configuration options. Alternatively, some configurable putters provide so many configuration options as to require overly complex assembly. Such putters may also have undesirable aesthetics due to the large number of separate components and connections.

It is to improvements in the design of configurable golf putters that the present disclosure is directed.

SUMMARY

In one aspect of the disclosure, a golf putter head assembly is provided that includes a putter head and a two-part hosel detachably mounted to the putter head by way of a single removable fastener. The putter head includes a front face, a back, a toe, a heel, a sole, and a crown. The front face and back of the putter head are offset from each other in a putting stroke direction. The toe and heel of the putter head are offset from each other in a direction that is transverse to the putting stroke direction. The sole and crown of the putter head are offset from each other in a vertical direction. The putter head further includes a through-bore extending from an upper opening thereof formed in the crown of the putter head to a lower opening thereof formed in the sole of the putter head, the through-bore being disposed closer to the heel of the putter head than the toe of the putter head.

The two-part hosel includes a lower intermediate connector and an upper shaft connector detachably connected to each other. The intermediate connector is configured as a substantially straight tube-like structure having a lower end, an upper end, and a through-bore extending from a lower opening thereof formed in the lower end of the intermediate connector and an upper opening thereof formed in the upper end of the intermediate connector, the lower end of the intermediate connector being removably disposed within the upper opening of the putter head, with the intermediate connector through-bore being substantially in axial alignment with the putter head through-bore. The shaft connector includes a lower member configured as a substantially straight tube-like structure, an upper member configured as a substantially straight tube-like structure, and an intermediate member configured as a transverse support interconnecting the lower member and the upper member in mutual offset relationship in the putting stroke direction. The lower member of the shaft connector includes an upper end connected to the intermediate member, a lower end removably disposed within the upper opening of the intermediate connector, and a blind bore opening at a lower end of the lower member, the blind bore being substantially in axial alignment with the through-bore of the intermediate connector. The upper member of the shaft connector includes a lower end connected to the intermediate member, an upper end, and a blind bore opening at the upper end of the upper member that is sized to receive a putter shaft.

The upper member of the shaft connector is angled relative to the lower member of the shaft connector at a selected angle that establishes a lie angle between the putter head and the putter shaft when the putter shaft is mounted to the putter head assembly to form a putter. The upper member of the shaft connector is offset from the lower member of the shaft connector at a selected distance that establishes an offset distance between the front face of the putter head and the putter shaft when the putter shaft is mounted to the putter head assembly to form a putter. The intermediate connector has a selected length that establishes a head balance characteristic of a putter formed by joining the golf putter head assembly to the putter shaft. The removable fastener extends from the lower opening formed in the sole of the putter head to the blind bore formed in the lower member of the shaft connector. The removable fastener secures the putter head, the intermediate connector and the shaft connector in a state of fixed mutual attachment.

In another aspect of the disclosure, a golf putter head assembly kit is provided for assembling a golf putter head assembly as summarized above. The assembly kit includes a set of two or more interchangeable versions of the putter head, a set of two or more interchangeable versions of the intermediate connector, a set of two or more interchangeable versions of the removable fastener, and a set of two or more interchangeable versions of the shaft connector.

In the set of two or more interchangeable versions of the putter head, each putter head may have a unique configuration that differs from the configuration of any other version of the putter head in the set (excluding duplicates and spares). In the set of two or more interchangeable versions of the intermediate connector, each intermediate connector may extend upwardly from the putter head at the same angle when mounted thereto. Each intermediate connector may have a unique length that differs from the length of any other version of the intermediate connector in the set (excluding duplicates and spares). In the set of two or more interchangeable versions of the removable fastener, each removable fastener may have a unique length that differs from the length of any other version of the removable fastener in the set (exclusive of duplicates and spares), so as to be compatible for use with one of the intermediate connectors based on the length of that intermediate connector. In the set of two or more interchangeable versions of the shaft connector, each shaft connector's lower member may extend upwardly from the intermediate connector at the same angle when mounted thereto. Each shaft connector's upper member may form a unique angle with the shaft connector's lower member that differs from the angle of the upper member of any other version of the shaft connector in the set (excluding duplicates and spares). In the set of two or more interchangeable versions of the shaft connector, each shaft connector's upper member may be offset from the lower member at a selected distance that establishes an offset distance between the front face of the putter head and the putter shaft when the putter shaft is mounted to the putter head assembly to form a putter. Each shaft connector's upper member may be offset from the shaft connector's lower member at an offset distance that differs from the offset distance of any other version of the shaft connector in the set (exclusive of duplicates and spares).

In another aspect of the disclosure, a golf putter assembly method is provided for assembling a golf putter from a golf putter head assembly kit as summarized above. The method includes, in any order, selecting one of the putter heads of the assembly kit, selecting one of the intermediate connectors of the assembly kit according to a desired head balance characteristic, selecting one of the shaft connectors of the assembly kit according to desired lie angle and a desired offset distance between the front face of the putter head and the putter shaft, selecting a putter shaft, assembling the golf putter head assembly by interconnecting the selected intermediate connector to the selected shaft connector to form the two-part hosel, and mounting the two-part hosel to the putter head using the removable fastener. Prior to or after mounting the two-part hosel to the putter head, the selected putter shaft may be mounted to the two-part hosel.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
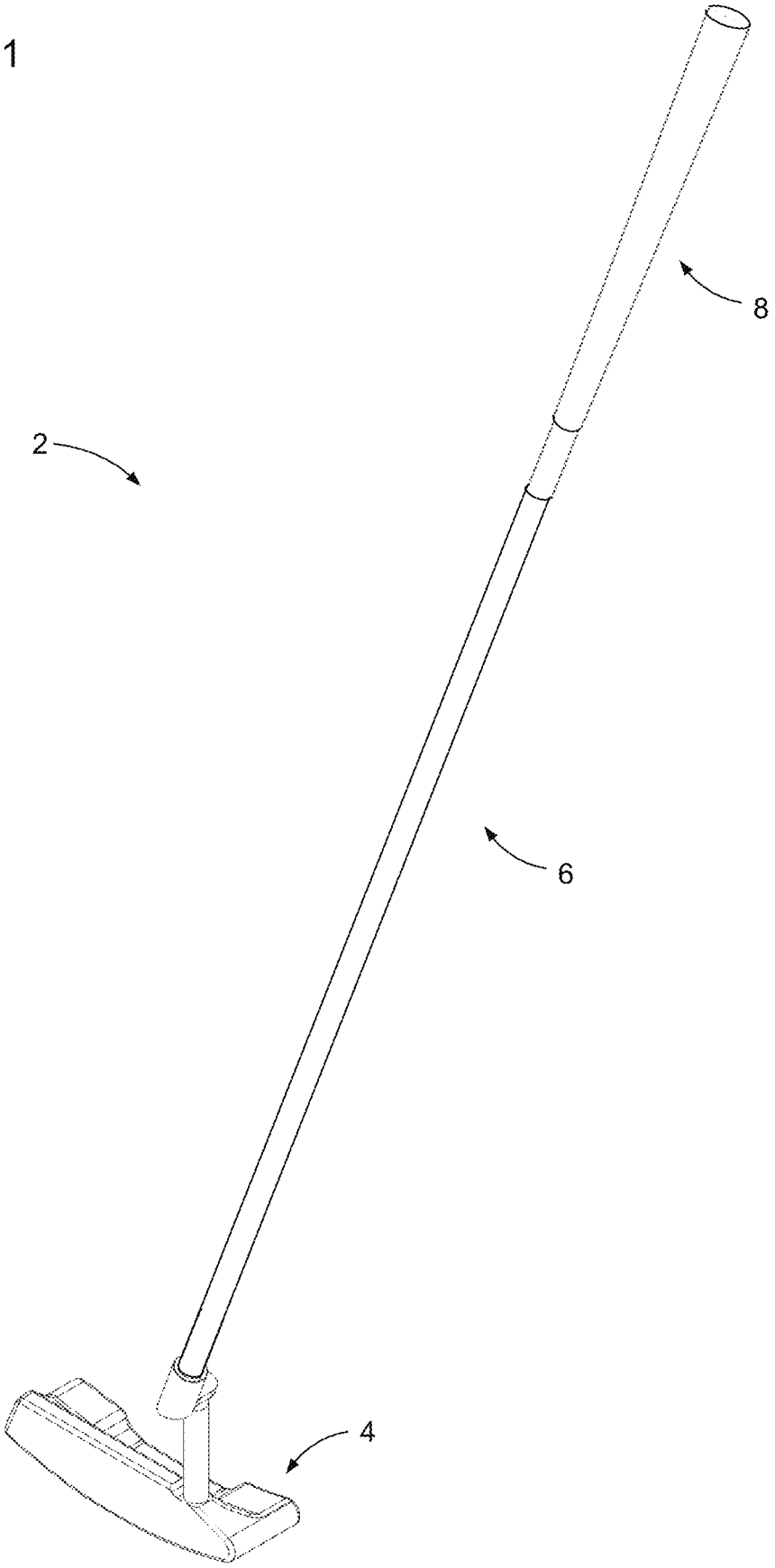
FIG. 1 is a perspective view showing an example golf putter that may be constructed according to the present disclosure.

Turning now to the drawing figures, which are not necessarily to scale, FIG. 1 illustrates an example embodiment of a golf putter 2 that may be constructed in accordance with the present disclosure. The putter 2 includes a configurable putter head assembly 4, a putter shaft 6 attached to the putter head assembly 4, and a grip 8 disposed at an upper end of the putter shaft.

Figure 2:
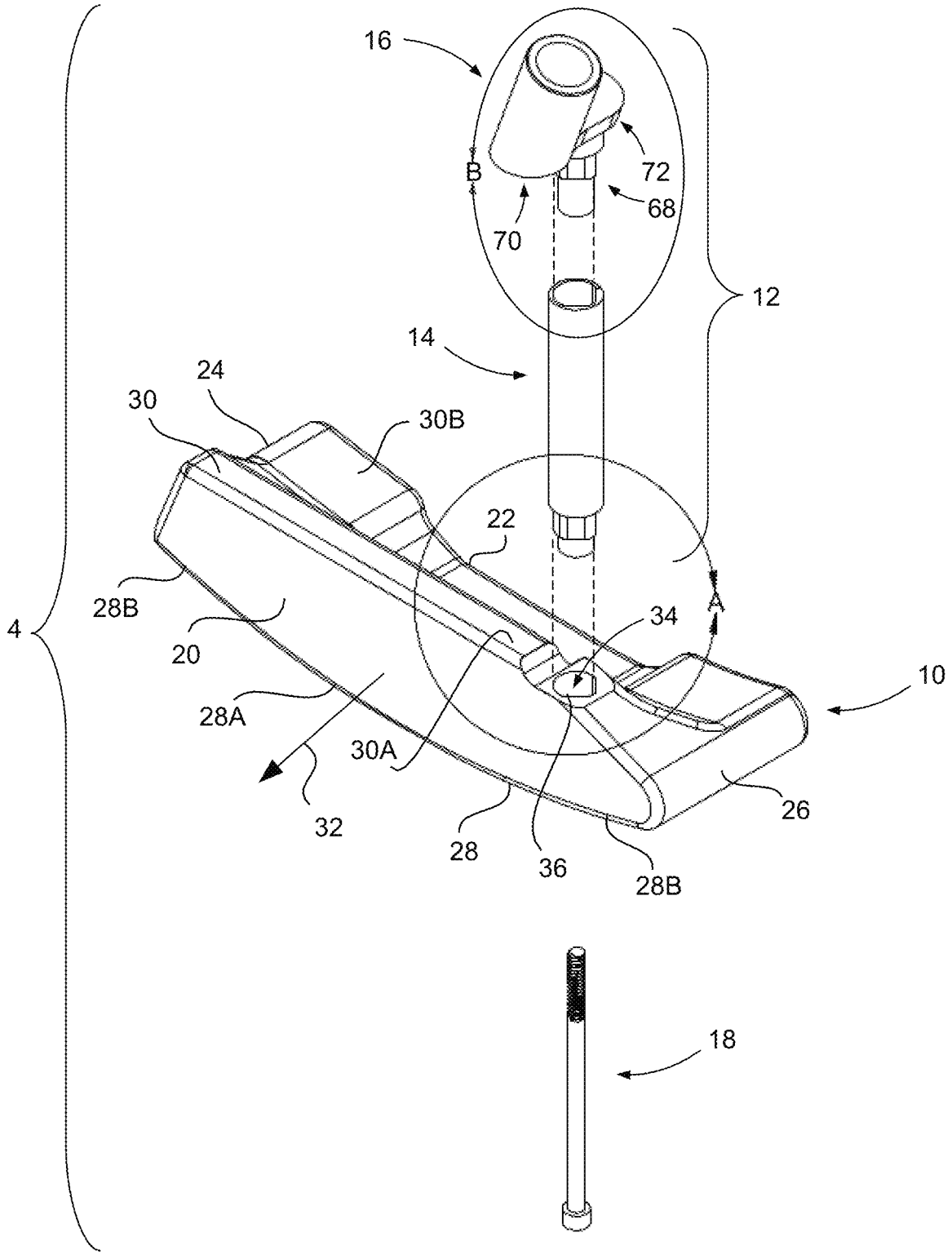
FIG. 2 is an exploded perspective view showing a putter head assembly that may be used in the golf putter of FIG. 1.

As shown in FIG. 2, the golf putter head assembly 4 includes a putter head 10 and a two-part hosel 12 that includes a lower intermediate connector 14 and an upper shaft connector 16. The two-part hosel 12 is detachably mounted to the putter head by way of a single removable fastener 18. As described in more detail below, the intermediate connector 14 provides a lower part of the two-part hosel 12 that mounts to the putter head 10 and extends upwardly therefrom. The upper shaft connector 16 mounts to and extends upwardly from the intermediate connector 14, and is configured for attachment to the putter shaft 6. The foregoing components of the putter head assembly 4 may be fabricated from any suitable material, including but not limited to steel, titanium, aluminum, zinc, etc., and/or combinations of such materials.

The putter head 10 may have any configuration typically associated with various types of golf putters, including but not limited to blade putters, mallet putters, half-mallet putters, etc. By way of example only, the putter head 10 depicted in the illustrated embodiment is configured as a blade-style putter. The putter head 10 includes a front face 20, a back 22, a toe 24, a heel 26, a sole 28, and a crown 30. The front face 20 and the back 22 of the putter head 10 are offset from each other in a putting stroke direction 32. This offset distance defines a depth dimension of the putter head 10. The toe 24 and the heel 26 of the putter head 10 are offset from each other in a direction that is substantially transverse to the putting stroke direction 32. This offset distance defines a width dimension of the putter head 10. The sole 28 and the crown 30 of the putter head 10 are offset from each other in a direction that is substantially parallel to the putter face. This offset distance defines a height dimension of the putter head 10.

As is typical of most golf putters, the front face 20 of the putter head 10 may be substantially planar, and may be nearly vertically oriented when the putter head is in the putter's address position to provide a standard putter loft angle of between 2-4 degrees. The back 22 of the putter head 10 may also be planar, or alternatively, may have an irregular or other non-planar shape. The toe 24 and the heel 26 of the putter head 10 may have a curved or angled configuration when the putter head is viewed from the front face 20 looking rearwardly, and may have a straight, non-curved configuration when the putter head is viewed looking downwardly from above the crown 30. The sole 28 of the putter head 10 will typically be substantially straight in the stroke direction 32 (i.e. from the front face 20 to the rear 22), and will be horizontally oriented in the address position. Transverse to the stroke direction 32 (i.e., along the length of the putter head between the toe 24 and the heel 26), a mid-region 28A of the sole 28 of the putter head 10 may be straight and horizontal in the address position, whereas toe and heel ends 28B of the sole may be upwardly curved. The crown 30 of the putter head 10 may have an irregular or other non-planar configuration that varies in height along the length and depth dimensions of the putter head. For example, the crown 30 may be formed with a raised blade edge 30A proximate to the front face 20 of the putter head 10, and may have a lower rear projection 30B disposed behind the blade edge.

Figure 3:
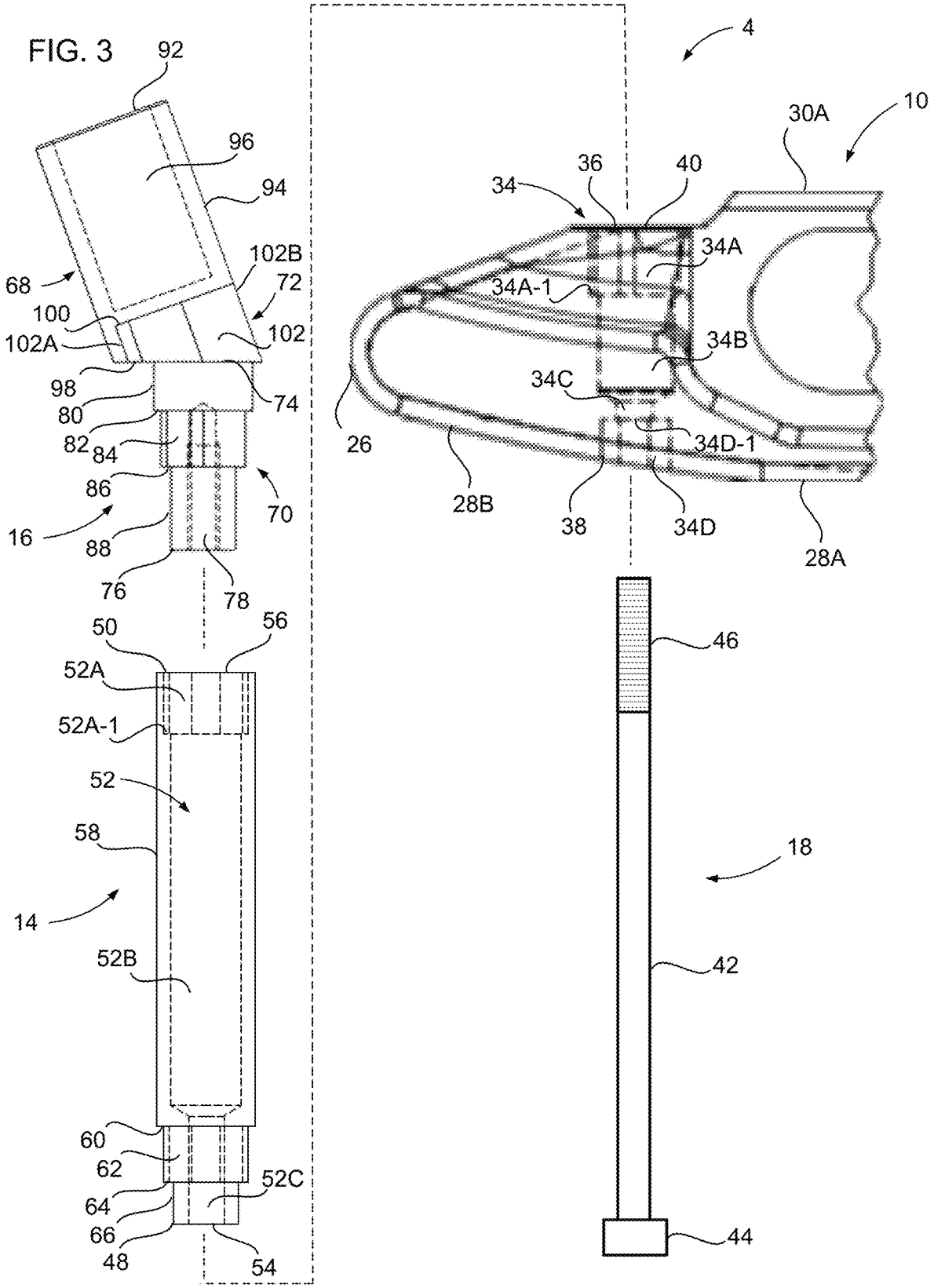
FIG. 3 is an exploded side elevation view showing the putter head assembly of FIG. 2 in a disassembled state.
Figure 4:
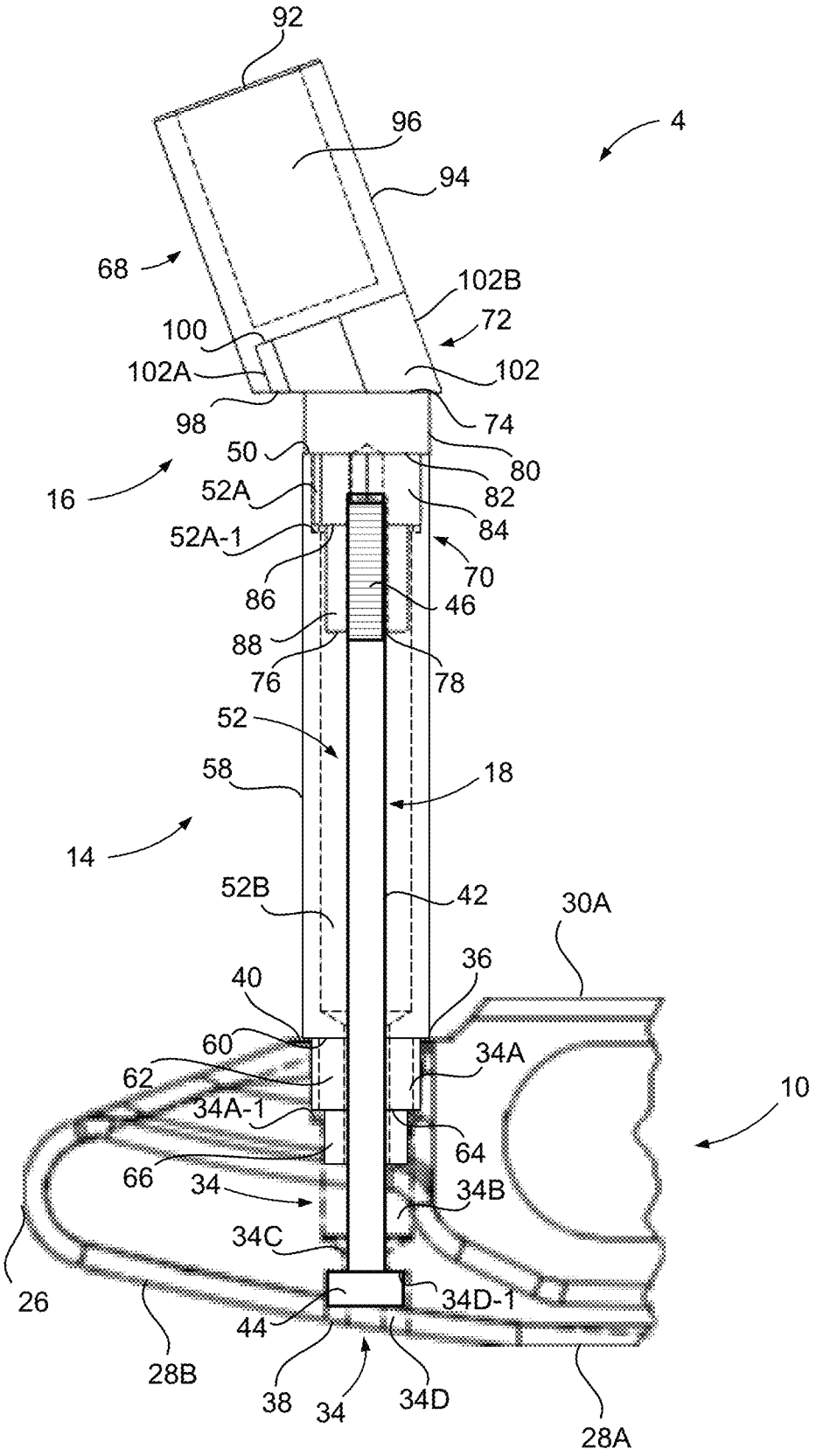
FIG. 4 is a side elevation view showing the putter head assembly of FIG. 2 in an assembled state.

With continuing reference to FIG. 2, and as additionally shown in FIGS. 3 and 4, the putter head 10 is formed with a through-bore 34. The through-bore 34 extends from an upper opening 36 thereof formed in the crown 30 of the putter head to a lower opening 38 thereof formed in the sole 28 of the putter head. Transverse to the stroke direction 32 of the putter head 10 (i.e., along the length of the putter head between the toe 24 and the heel 26), the through-bore 34 may located anywhere between the toe and the heel, but typically will be disposed closer to the heel than to the toe (i.e., within a region between the heel and midway along the length of the putter head). Parallel to the stroke direction 32 of the putter head 10 (i.e., along the depth of the putter head between the front face 20 and the rear 22), the through-bore 34 may located anywhere between the front face and the toe, but typically will be disposed closer to the front face than to the rear (i.e., within a region between the front face and midway along the depth of the putter head). As shown in FIG. 2, the through-bore 34 may be arranged to extend substantially vertically when the putter head is in the address position. In this arrangement, the through-bore 34 will be aligned nearly parallel to the blade edge 30A and will be at a neutral angle relative to the length dimension of the putter head so as not to tilt toward either the toe 24 or the heel 26 of the putter head.

Figure 5:
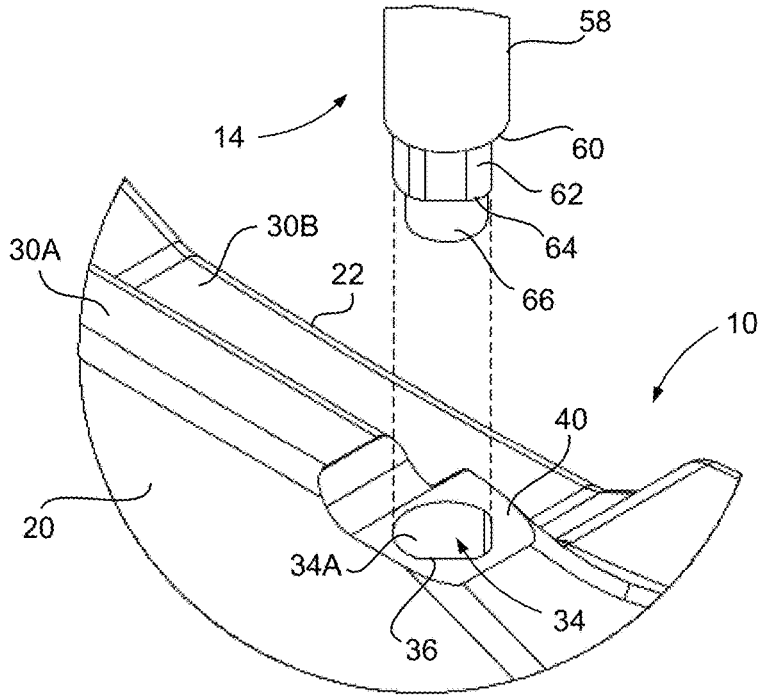
FIG. 5 is an enlarged exploded perspective view showing the contents of inset "A" in FIG. 2.
Figure 6:
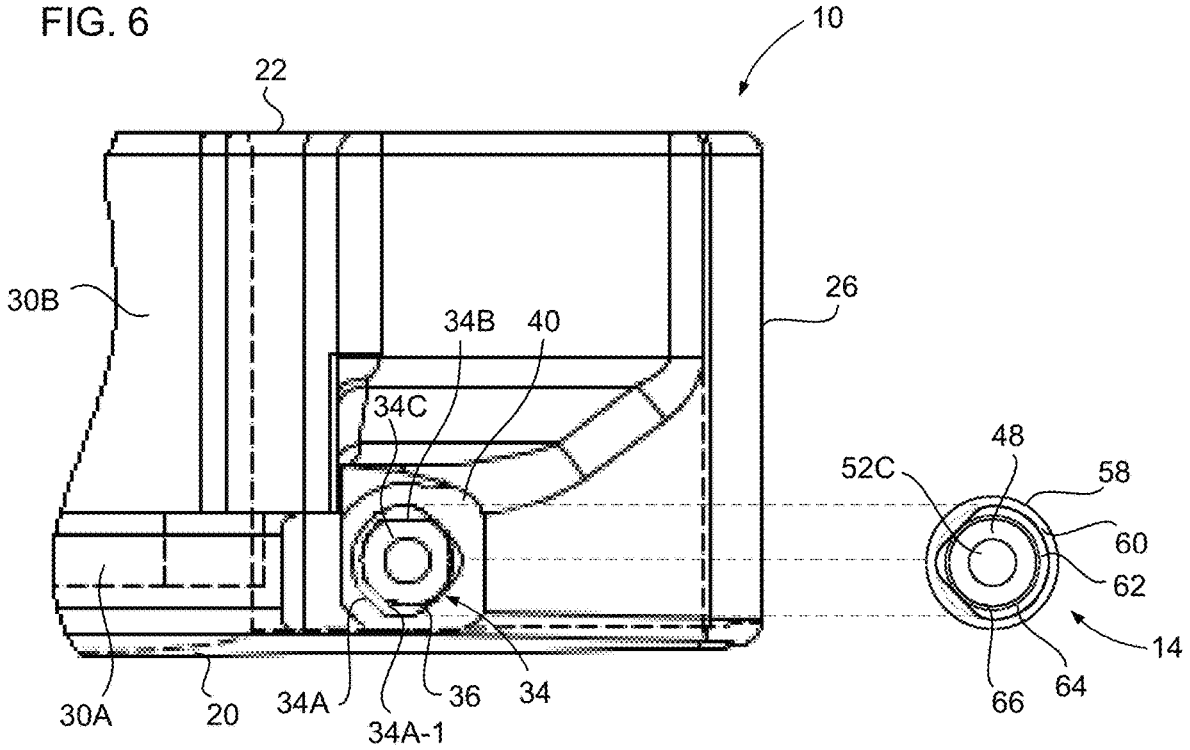
FIG. 6 is a partial top plan view showing a putter head and an intermediate connector of the putter head assembly of FIG. 2.

As shown in FIG. 3, the upper opening 36 of the through-bore 34 may be disposed on a horizontal seat 40 that is downwardly recessed from the main surface of the blade edge 34A, which is on the crown 34 of the putter head 10. Below the upper opening 36, the through-bore 34 may be formed with a non-cylindrical indexing slot 34A that extends downwardly from the upper opening to a internal shoulder 34A-1. As additionally shown in FIGS. 5-6, which depict the structure shown in inset "A" of FIG. 2, the indexing slot 34A has a non-circular indexing profile whose purpose is to prevent rotation of the two-part hosel 12 relative to the putter head 10. FIGS. 5 and 6 illustrate an example wedge-shaped configuration of the indexing slot 34A that bears resemblance to a pie slice, but it will be understood that many other configurations could also be used. Below the indexing slot 34A, the through-bore 34 is cylindrical but may have sections of different diameter. For example, a large diameter cylindrical bore section 34B may extend below the indexing slot 34A to small diameter cylindrical bore section 34C that is sized slightly larger than the shank diameter of the fastener 18. The fastener 18 may itself be embodied as a bolt or screw having a cylindrical shank 42, an enlarged cylindrical head 44 at one end of the shank, and threads 46 at the other end of the shank. If the fastener 18 is so constructed, the lower opening 38 of the through-bore 34 may be formed with a cylindrical counterbore 34D that seats the fastener head 44. The fastener head's seated arrangement is shown in FIG. 4. The counterbore 34D extends upwardly from the lower opening 38 of the through-bore 34 to an internal shoulder 34D-1.

With continuing reference to FIGS. 2-4, the lower intermediate connector 14 and the upper shaft connector 16 of the two-part hosel 12 are detachably connected to each other by way of the fastener 18. As shown in FIG. 3, the intermediate connector 14 is configured as a substantially straight, tube-like structure having a lower end 48, an upper end 50, and a through-bore 52. The tube-like structure may be circular in shape, with non-circular tube configurations also be possible. The through-bore 52 extends from a lower opening 54 thereof formed in the lower end 48 of the intermediate connector and an upper opening 56 thereof formed in the upper end 50 of the intermediate connector. As shown in FIG. 4, the lower end 48 of the intermediate connector 14 is removably disposed within the upper opening 36 of the putter head, with the intermediate connector's through-bore 52 being substantially in axial alignment with the putter head's through-bore 34. With this configuration, the intermediate connector will extend substantially vertically upwardly when the putter head 10 is in the address position.

As shown in FIG. 3, the through-bore 52 of the intermediate connector 14 may be formed with a non-cylindrical indexing slot 52A that extends downwardly from the upper opening 56 of the through-bore to an internal shoulder 52A-1. The indexing slot 52A may have the same wedge-shaped configuration as the indexing slot 34A in the putter head's through-bore 34. The purpose of the indexing slot 52A is to prevent rotation of the shaft connector 16 relative to the intermediate connector 14. This arrangement is described in more detail below in connection with FIGS. 7 and 8. Below the indexing slot 52A, the through-bore 52 is cylindrical but may have sections of different diameter. For example, a large diameter cylindrical bore section 52B may extend below the indexing slot 52A to small diameter bore section 52C that is sized slightly larger than the shank diameter of the fastener 18.

The intermediate connector 14 may have an outer cylindrical wall section 58 serving as a main wall section that will be exposed to view when the intermediate connector is mounted to the putter head 10. Non-cylindrical (e.g., polygonal) wall configurations could also be used. The cylindrical wall section 58 extends from the intermediate connector's upper end 50 to a first (upper) external shoulder 60. Below the cylindrical wall section 58 is a non-cylindrical wall section of the intermediate connector 14 that serves as an indexing pin 62. As additionally shown in FIGS. 5-6, the indexing pin 62 has a non-circular indexing profile that matches the non-circular indexing profile of the indexing slot 34A formed as part of the putter head's through-bore 34. The intermediate connector 14 and the putter head 10 will thus be joined together by a non-rotatable interconnection that prevents rotation of the intermediate connector relative to the putter head. The non-rotatable interconnection is provided by the lower end portion of the intermediate connector 14 that includes the indexing pin 62 being rotatably indexed to the upper opening portion of the putter head 10 that includes the indexing slot 34A.

The indexing pin 62 of the intermediate connector 14 extends downwardly from the upper external shoulder 60 to a second (lower) external shoulder 64. Below the indexing pin 62 is a lower terminal section 66 whose outside surface is of cylindrical shape. The terminal section 66 extends downwardly from the lower external shoulder 64 to the lower end 48 of the intermediate connector 14. The terminal section 66 may have a diameter that is slightly smaller than the diameter of the cylindrical bore section 34B of the putter head's through-bore 34.

As can be seen in FIGS. 4 and 5, when the intermediate connector 14 is mounted to the putter head 10, the indexing pin 62 of the intermediate connector will be captured within the indexing slot 34A of the putter head's through-bore 34 to provide the above-described non-rotatable interconnection between the intermediate connector and the putter head. As shown in FIG. 4, the upper external shoulder 60 of the intermediate connector 14 will be seated on the horizontal seat 40 that surrounds the putter head's through-bore 34. The lower external shoulder 64 of the intermediate connector 14 will be situated on or proximate to the internal shoulder 34A-1 of the putter head's through-bore 34. The lower terminal section 66 of the intermediate connector 14 will be captured within the larger diameter cylindrical section 34B of the putter head's through-bore 34. As previously noted, the intermediate connector's through-bore 52 will be substantially in axial alignment with the putter head's through-bore 34.

As can be seen in FIG. 2, the shaft connector 16 includes a lower member 68 configured as a substantially straight tube-like structure (e.g, a circular tube), an upper member configured 70 as a substantially straight tube-like structure (e.g, a circular tube), and an intermediate member 72 configured as a transverse support interconnecting the lower member and the upper member in mutual offset relationship in the putting stroke direction 32. As can be seen in FIGS. 3-4, the lower member 68 of the shaft connector 16 includes an upper end 74 connected to the intermediate member 72 and a lower end 76 removably disposed within the upper opening 56 of the intermediate connector 14. An internally threaded, cylindrical blind bore 78 opens at the lower end 76 of the shaft connector's lower member 70. The blind bore 78 is substantially in axial alignment with the through-bore 52 of the intermediate connector 14.

The lower member 70 of the shaft connector 16 may have an outer cylindrical wall section 80 serving as a main wall section that will be exposed to view when the shaft connector is mounted to the intermediate connector 14. Non-cylindrical (e.g., polygonal) configurations could also be used, particularly when the exposed wall section 58 of the intermediate connector 14 is non-cylindrical. The cylindrical wall section 80 extends from the lower member's upper end 74 to a first (upper) external shoulder 82. Below the cylindrical wall section 80 is a non-cylindrical wall section of the lower member 70 that serves as an indexing pin 84. As additionally shown in FIGS. 7-8, the indexing pin 84 has a non-circular indexing profile that matches the non-circular indexing profile of the indexing slot 52A formed as part of the intermediate connector's through-bore 52. The shaft connector 16 and the intermediate connector 14 will thus be joined together by a non-rotatable interconnection that prevents rotation of the shaft connector relative to the intermediate connector. The non-rotatable interconnection is provided by the lower end portion of the shaft connector 16 that includes the indexing pin 84 being rotatably indexed to the upper opening portion of the intermediate connector 14 that includes the indexing slot 52A.

The indexing pin 84 extends downwardly from the upper external shoulder 82 to a second (lower) external shoulder 86. Below the indexing pin 84 is a lower terminal section 88 whose outside surface is of cylindrical shape. The terminal section 88 extends downwardly from the lower external shoulder 86 to the lower end 76 of the lower member 70. The terminal section 88 may have a diameter that is slightly smaller than the diameter of the cylindrical bore section 52B of the intermediate connector's through-bore 52. The shaft connector's lower member 70 thus includes a circular profile above and below the indexing pin 84 that includes the cylindrical upper wall section 80 and the cylindrical lower terminal section 88.

Figure 7:
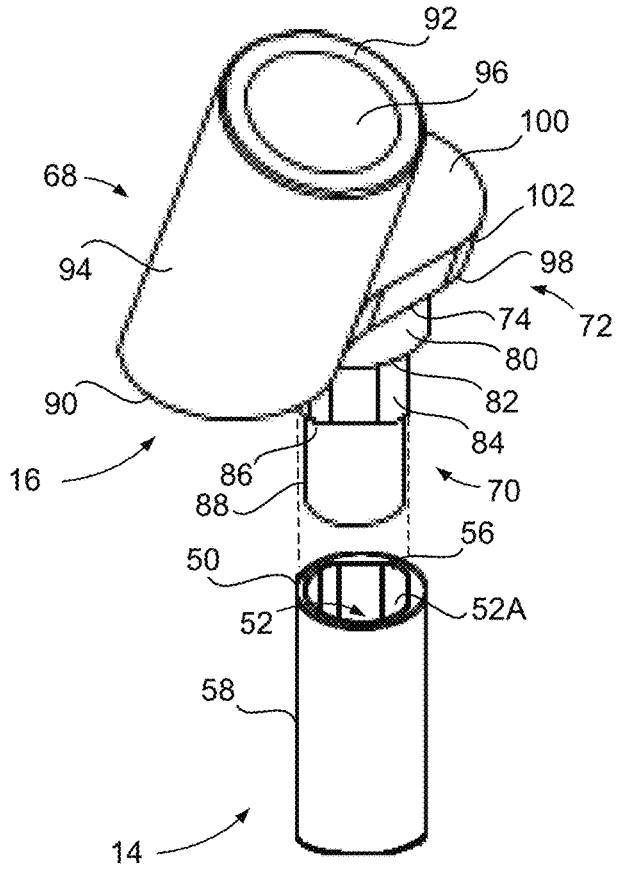
FIG. 7 is an enlarged exploded perspective view showing the contents of inset "B" in FIG. 2.
Figure 8:
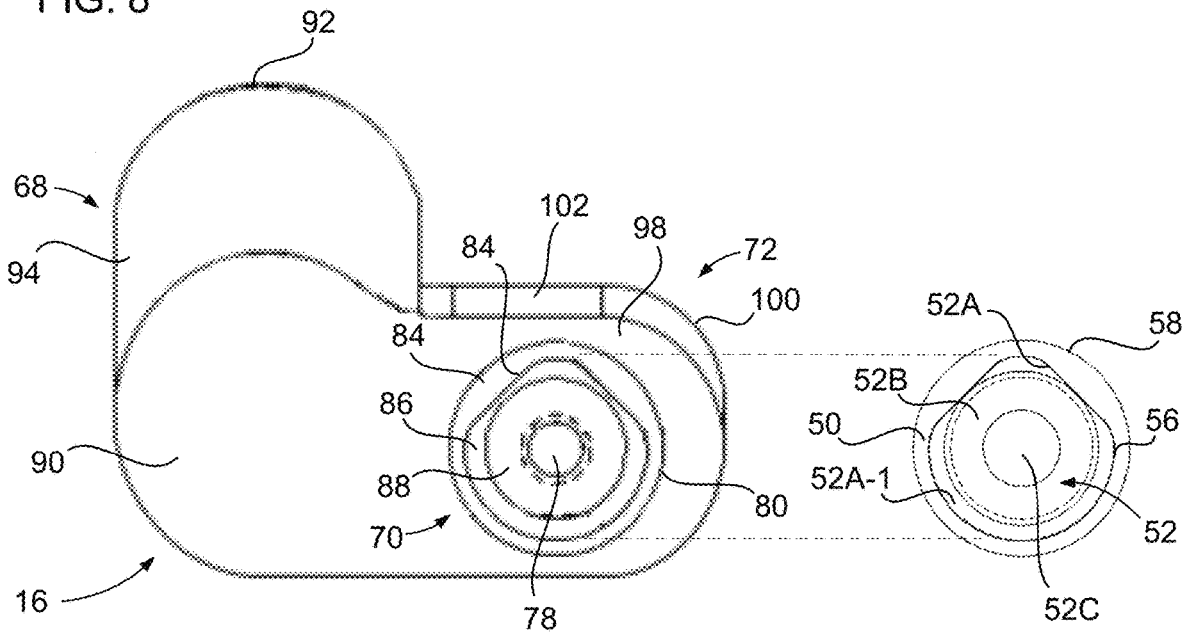
FIG. 8 is a bottom plan view showing a shaft connector and an intermediate connector of the putter head assembly of FIG. 2 prior to attachment of the intermediate connector to the shaft connector.

As can be seen in FIGS. 7 and 8, when the shaft connector 16 is mounted to the intermediate connector 14, the indexing pin 84 of the lower member 70 will be captured within the indexing slot 52A of the intermediate connector's through-bore 52 to provide the above-described non-rotatable interconnection between the upper shaft connector and the intermediate connector. As shown in FIG. 4, the upper external shoulder 82 of the lower member 70 will be seated on the upper end 50 of the intermediate connector 14. The lower external shoulder 86 of the lower member 70 will be situated on or proximate to the internal shoulder 52A-1 of the intermediate connector's through-bore 52. The lower terminal section 88 of the lower member 70 will be captured within the larger diameter cylindrical section 52B of the putter head's through-bore 52. As previously noted, the lower member's blind bore 78 will be substantially in axial alignment with the through-bore 52 of the intermediate connector 14, which as also noted above, is substantially in axial alignment with the through-bore 34 of the putter head 10. Thus, when the removable fastener 18 is installed, it will extend from the lower opening 38 formed in the sole 28 of the putter head 10 to the blind bore 78 formed in the lower member 70 of the shaft connector 16. The removable fastener 18 thereby secures the putter head 10, the intermediate connector 14, and the shaft connector 16 in a state of fixed mutual attachment.

As can be seen in FIGS. 7-8, the upper member 68 of the shaft connector 16 may be configured as a cylindrical tube-like structure that includes a lower end 90 connected to the shaft connector's intermediate member 72, an upper end 92, and a cylindrical sidewall 94. Non-cylindrical configurations could also be used. A cylindrical blind bore 96 opens at the upper end 92 of the upper member and is sized to receive the lower end of the putter shaft 6. The intermediate member 72 of the shaft connector 16 may be configured as a bar-like structure of irregular shape that includes a horizontal lower surface 98, an angled upper surface 100, and peripheral sidewall 102 of varying height that extends between the lower surface and the upper surface. As best shown in FIG. 8, the lower surface 98 may be coextensive with the lower end 90 of the upper member 68.

Figure 9:
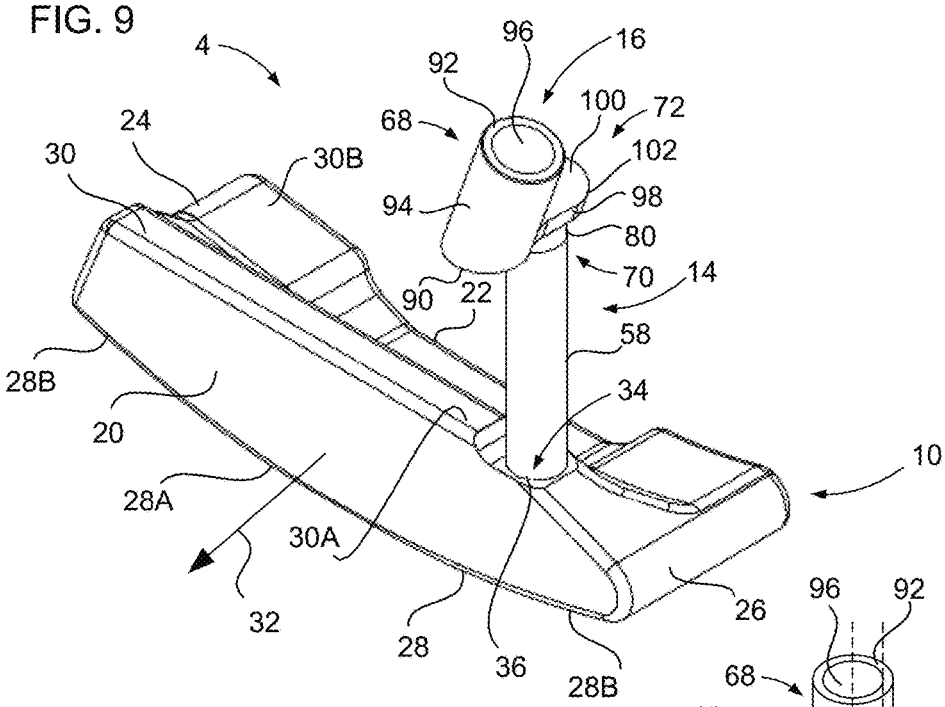
FIG. 9 is a perspective view showing the putter head assembly of FIG. 2.
Figure 10:
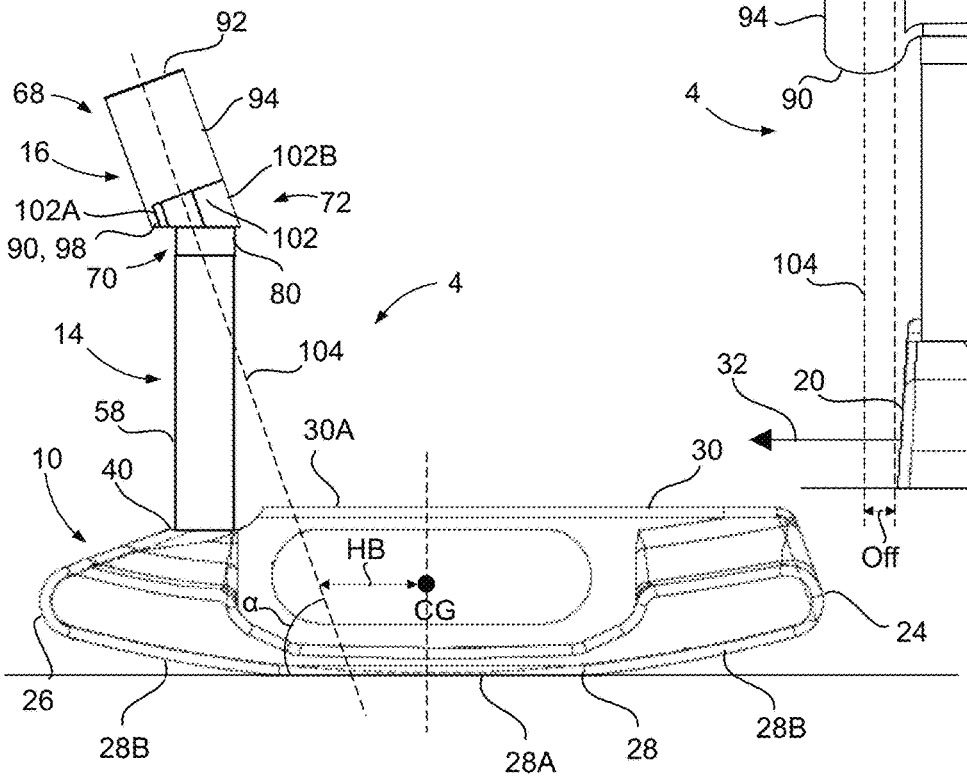
FIG. 10 is a rear side elevation view showing the putter head assembly of FIG. 2.
Figure 11:
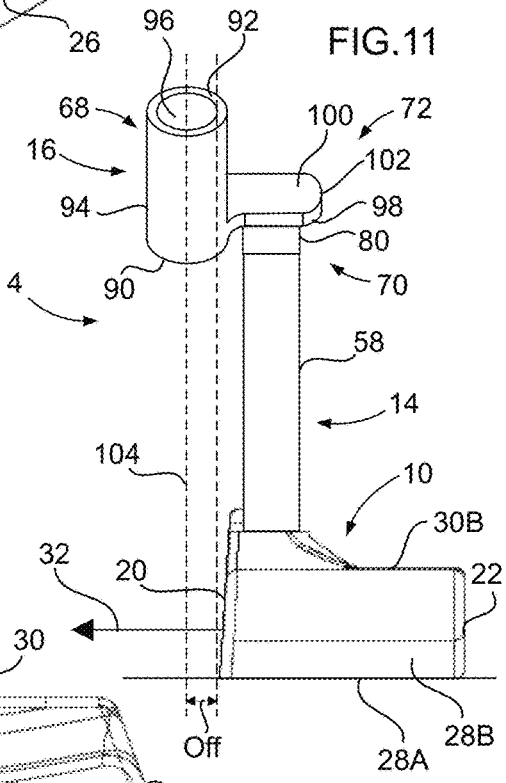
FIG. 11 is a heel end elevation view showing the putter head assembly of FIG. 2.

FIGS. 9-11 illustrate additional configuration characteristics of the shaft connector 16. For example, as shown in FIG. 10, the upper member 68 of the shaft connector 16 is angled relative to the lower member 70 of the shaft connector at a selected angle that establishes a lie angle $\alpha$ between the putter head 10 and a longitudinal axis 104 of the putter shaft 6. As can also be seen in FIGS. 3 and 4, the angle made by the upper member 68 with respect to the lower member 70 may be obtained by forming the intermediate member 72 with a wedge-shaped sidewall 102 having a minimum height section 102A on a first side thereof that faces the heel 26 of the putter head 10 and a maximum height section 102B on a second side thereof that faces the toe 24 of the putter head. This produces the angled orientation of the upper surface 100 of the intermediate member 72 that in turn tilts the upper member 68 to form the desired lie angle.

As shown in FIG. 11, the intermediate member 72 of the shaft connector 68 may be sized so that the upper member 68 of the shaft connector is offset from the lower member 70 of the shaft connector at a selected distance. The selected distance establishes an offset distance "Off" between the front face 20 of the putter head 10 and the putter shaft 6 in the putting stroke direction 32.

As shown in FIG. 10, the intermediate connector 14 has a selected length that, for any particular lie angle, establishes a head balance characteristic of the putter 2. Assuming a given lie angle, the head balance characteristic is dictated by the length of the intermediate component 14, which in turn determines the distance "HB" between the longitudinal axis 104 of the putter shaft 6 and the center of gravity "CG" of the putter head 10. An inverse relationship exits. If the intermediate connector 14 is relatively short, the offset distance HB will be relatively long, such that the putter 2 will become more toe balanced. If the intermediate connector 14 is relatively long, the offset distance HB will be relatively short, such that the putter 2 will become less toe balanced. As the length of the intermediate connector 14 continues to increase, the offset distance HB will eventually reach zero, and the putter 2 will become face balanced. In the particular configuration shown FIG. 10, the length of the intermediate connector 14 is such that the putter 2 will be toe balanced. As noted, the putter 2 could be converted to a face balanced configuration by increasing the length of the intermediate connector 14 until the longitudinal axis 104 of the putter shaft 6 passes through the center of gravity CG of the putter head 10, meaning that the offset distance HB is zero.

Figure 12:
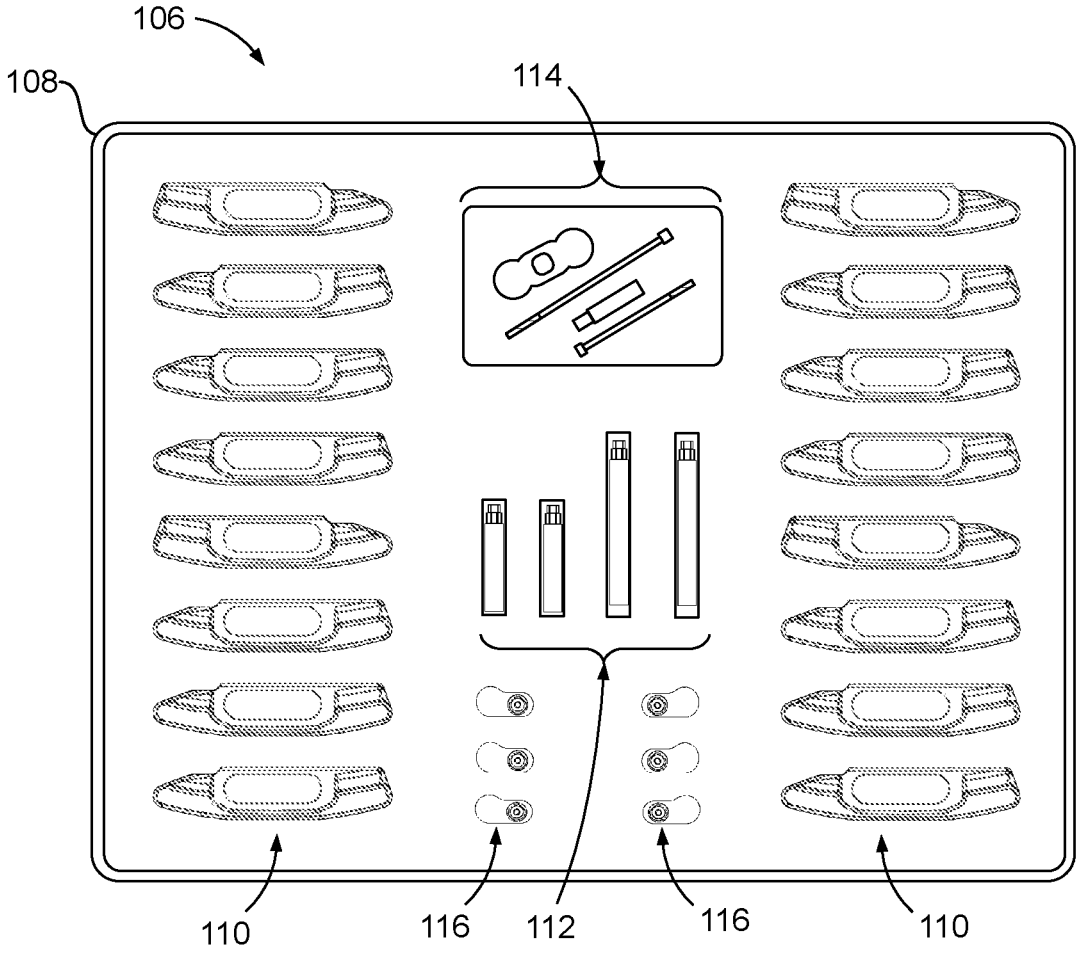
FIG. 12 is plan view showing a golf putter head assembly kit that may be provided in accordance with the the present disclosure.

Turning now to FIG. 12, a golf putter head assembly kit 106 is provided for assembling the golf putter head assembly 4 using combinations of different components to produce different golf putter head assembly configurations. The assembly kit 106 may include a multi-compartment tray or other holder 108 that carries one or more putter head sets 110 (two sets are shown) each set having of two or more interchangeable versions of the putter head 10, one (or more) intermediate connector sets 112 (one set is shown) each having two or more interchangeable versions of the intermediate connector 14, one or more removable fastener sets 114 (one set is shown) each having two or more interchangeable versions of the removable fastener 18, and one or more shaft connector sets 116 (two sets are shown) each having two or more interchangeable versions of the shaft connector 16.

In the set(s) 110 of two or more interchangeable versions of the putter head 10 in the golf putter head assembly kit 106, each individual putter head 10 may have a unique configuration that differs from the configuration of any other version of the putter head in the set(s) (excluding duplicates and spares), in terms of one or more characteristics, such as shape, style, weight, balance, materials, etc.

In the set(s) 112 of two or more interchangeable versions of the intermediate connector 14 in the golf putter head assembly kit 106, each intermediate connector may extend upwardly from the putter head 10 at the same angle when mounted thereto (e.g., vertically), but each may have a unique length that differs from the length of any other version of the intermediate connector in the set(s) (excluding duplicates and spares).

Figure 13A:
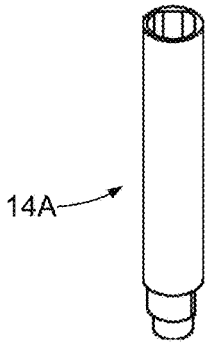
FIG. 13A is a perspective view showing an intermediate connector of the golf putter head assembly kit of FIG. 12.
Figure 14A:
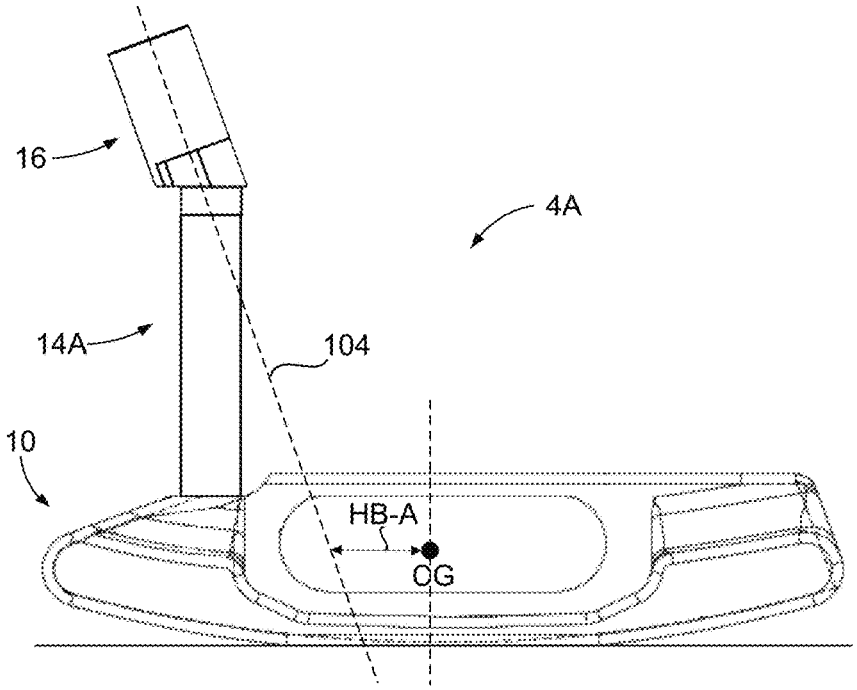
FIG. 14A is a rear elevation view showing a putter head assembly constructed using the intermediate connector of FIG. 13A and other components of the golf putter head assembly kit of FIG. 12.
Figure 13B:
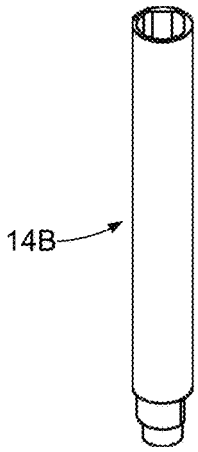
FIG. 13B is a perspective view showing another intermediate connector of the golf putter head assembly kit of FIG. 12.
Figure 14B:
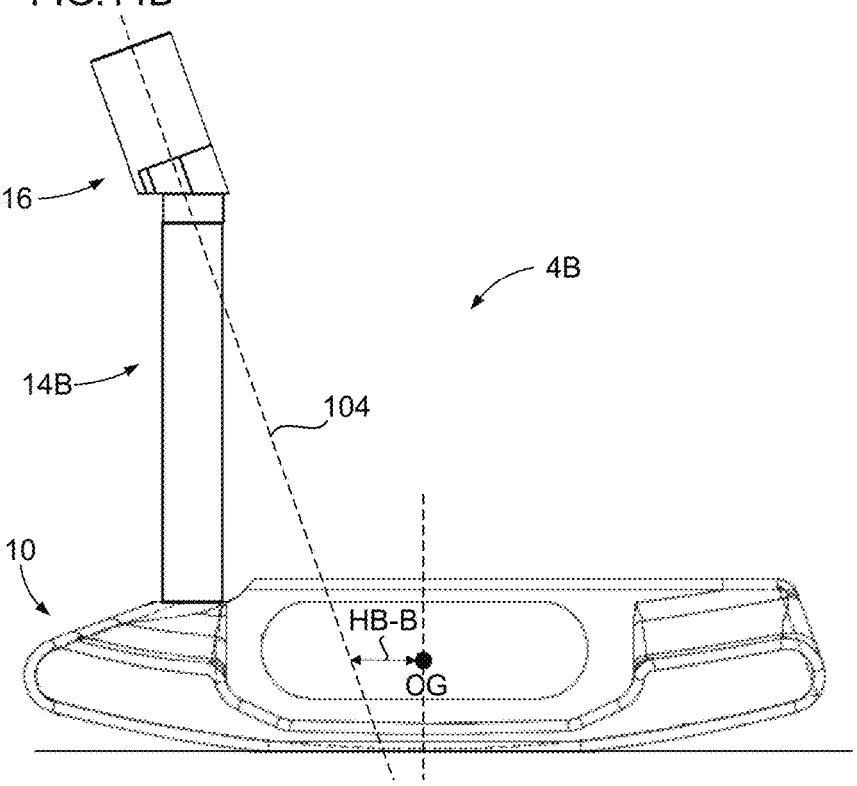
FIG. 14B is a rear elevation view showing another putter head assembly constructed using the intermediate connector of FIG. 13B and other components of the golf putter head assembly kit of FIG. 12.

As described above in connection with FIG. 10, the length of the intermediate connector 14 determines the head balance characteristic of the putter 2 for any selected lie angle. This is further illustrated in FIGS. 13-14. FIGS. 13A and 13B respectively depict intermediate connectors 14A and 14B having different lengths, with the intermediate connector 14A of FIG. 13A being comparatively short and the intermediate connector 14B of FIG. 13B being comparatively long. FIGS. 14A and 14B respectively depict putter head assemblies 4A and 4B having different head balance characteristics. The putter head assembly 4A of FIG. 14A uses the comparatively short intermediate connector 14A of FIG. 13A. Consequently, the distance "FIB-A" between the longitudinal axis 104 of the putter shaft 6 and the center of gravity "CG" of the putter head 10 is comparatively long. This imparts a strong toe balance characteristic to the putter 2. The putter head assembly 4B of FIG. 14B uses the comparatively long intermediate connector of FIG. 13B. Consequently, the distance "HB-B" between the longitudinal axis 104 of the putter shaft 6 and the center of gravity "CG" of the putter head 10 is comparatively short. This imparts a weaker toe balance characteristic to the putter 2.

It will be appreciated that switching between the intermediate connectors 14A and 14B may require changing the removable fastener 18 to accommodate the different lengths of the intermediate connectors. In the set(s) 114 of two or more interchangeable versions of the removable fastener 18 in the golf putter head assembly kit 106, each removable fastener may have a unique length that differs from the length of any other version of the removable fastener in the set(s) (excluding duplicates and spares) so as be compatible for use with one of the intermediate connectors 14 based on the length of that intermediate connector.

In the set(s) 116 of two or more interchangeable versions of the shaft connector 16 in the golf putter head assembly kit 106, each shaft connector's lower member 70 may be formed so that it will extend upwardly from the intermediate connector 14 at the same angle (e.g., vertically) when mounted thereto. Each shaft connector's upper member 68 may form a unique angle with the shaft connector's lower member 70 that differs from the angle of the upper member of any other version of the shaft connector 16 in the set(s) 116 (excluding spares and duplicates).

Figure 15A:
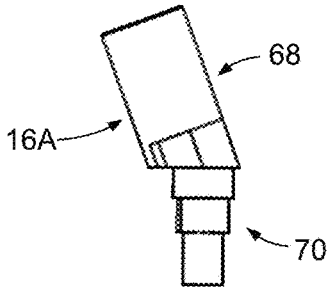
FIG. 15A is a perspective view showing a shaft connector of the golf putter head assembly kit of FIG. 12.
Figure 16A:
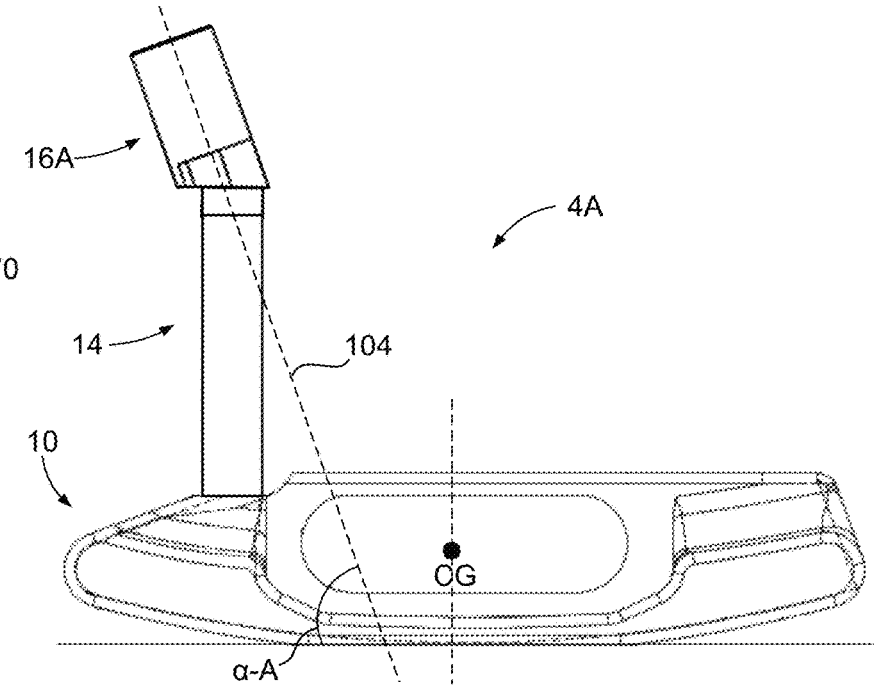
FIG. 16A is a rear elevation view showing a putter head assembly constructed using the shaft connector of FIG. 15A and other components of the golf putter head assembly kit of FIG. 12.
Figure 15B:
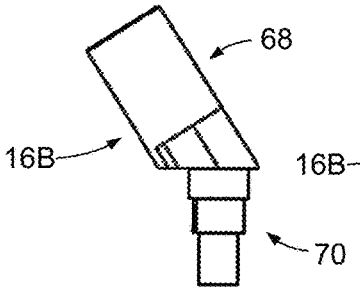
FIG. 15B is a perspective view showing another shaft connector of the golf putter head assembly kit of FIG. 12.
Figure 16B:
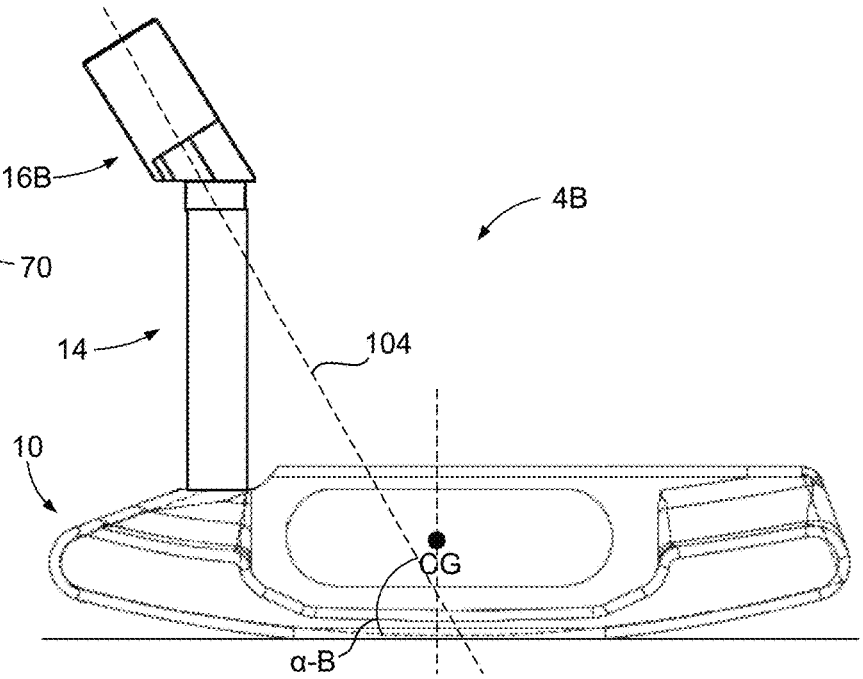
FIG. 16B is a rear elevation view showing another putter head assembly constructed using the shaft connector of FIG. 15B and other components of the golf putter head assembly kit of FIG. 12.

As described above in connection with FIG. 10, the angle between the shaft connector's upper member 68 and lower member 70 determines the lie angle of the putter 2. This is further illustrated in FIGS. 15-16. FIGS. 15A and 15B respectively depict shaft connectors 16A and 16B having different lie angles, with the shaft connector 16A of FIG. 15A providing a comparatively large lie angle and the shaft connector 16B of FIG. 15B providing a comparatively small lie angle. FIGS. 16A and 16B respectively depict putter head assemblies 4A and 4B having different lie angle characteristics. The putter head assembly 4A of FIG. 16A uses the shaft connector 16A of FIG. 15A to provide a comparatively large lie angle σ-A. The putter head assembly 4B of FIG. 16B uses the shaft connector 16B of FIG. 15B to provide a comparatively small lie angle σ-B.

It can be further seen from FIGS. 16A and 16B that changing the shaft connectors 16A and 16B in order to select between the lie angles σ-A and σ-B impacts the head balance characteristic of the putter 2. In particular, the shaft connector 16A that provides the lie angle σ-A produces more of a toe balanced characteristic whereas the shaft connector 16B that provides the lie angle σ-B produces less of a toe balanced characteristic. If it is desired to change the lie angle without changing the head balance characteristic of the putter 2, a different shaft connector 14 having an appropriate length may be selected. For example, if the shaft connector 14 of the putter head assembly 4B of FIG. 16B was sufficiently shortened, the head balance characteristic of the putter head assembly 4B could be maintained as it is in the putter head assembly 4A of FIG. 16A, such that the only difference between the two putter head assemblies 4A and 4B is the lie angle.

In the set(s) 116 of two or more interchangeable versions of the shaft connector 16 in the golf putter head assembly kit 106, the upper member 68 of the shaft connector may be offset from the lower member 70 of the shaft connector at a selected distance that establishes an offset distance between the front face 20 of the putter head 10 and the putter shaft 6. Each shaft connector's upper member 68 may be offset from the shaft connector's lower member 70 at an offset distance that differs from the offset distance of any other version of the shaft connector 16 in the set(s) 116 (excluding duplicates and spares).

Figure 17A:
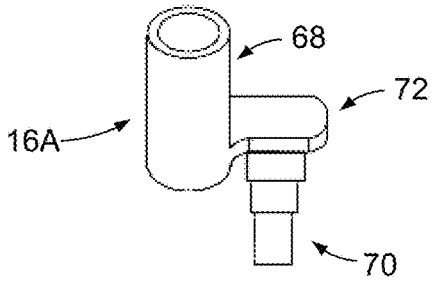
FIG. 17A is a perspective view showing a shaft connector of the golf putter head assembly kit of FIG. 12.
Figure 18A:
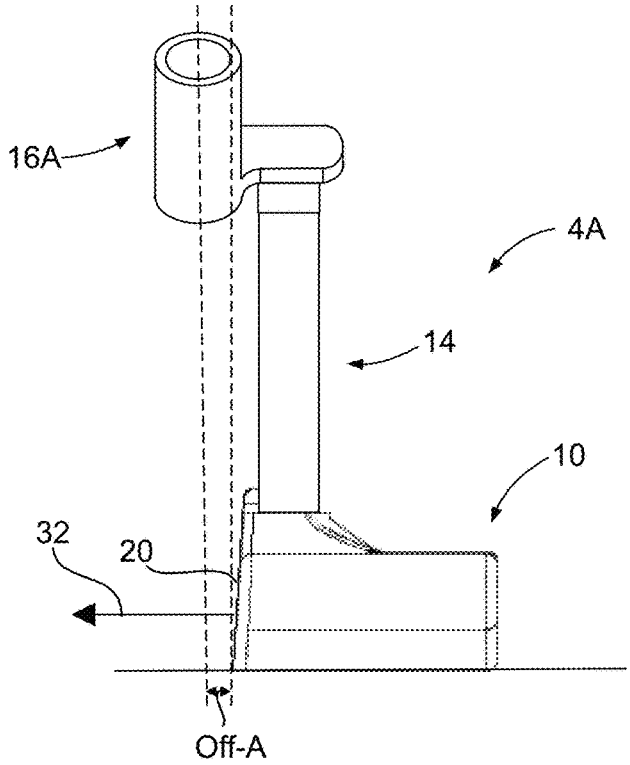
FIG. 18A is a rear elevation view showing a putter head assembly constructed using the shaft connector of FIG. 17A and other components of the golf putter head assembly kit of FIG. 12.
Figure 17B:
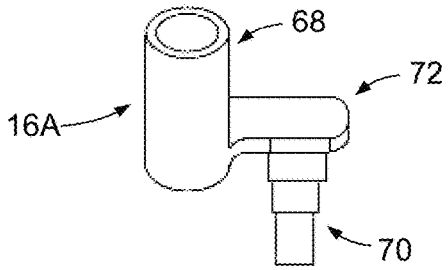
FIG. 17B is a perspective view showing another shaft connector of the golf putter head assembly kit of FIG. 12.
Figure 18B:
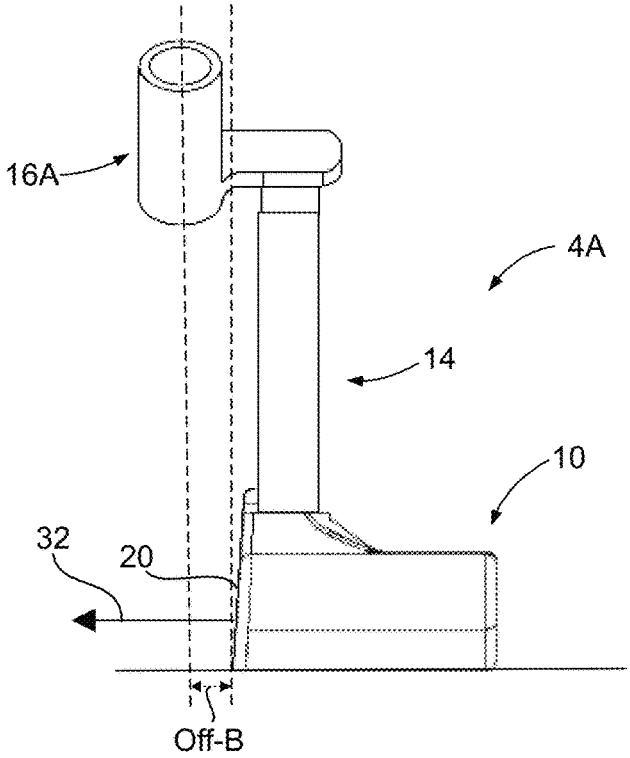
FIG. 18B is a rear elevation view showing another putter head assembly constructed using the shaft connector of FIG. 17B and other components of the golf putter head assembly kit of FIG. 12.

As described above in connection with FIG. 11, the offset between the shaft connector's upper member 68 and lower member 70 determines the offset distance "Off" between the putter head's front face 20 and the putter shaft 6. This is further illustrated in FIGS. 17-18. FIGS. 17A and 17B respectively depict shaft connectors 16A and 16B having different offset distances between the upper member 68 and the lower member 70, with the shaft connector 16A of FIG. 17A providing a comparatively small offset and the shaft connector 16B of FIG. 17B providing a comparatively large offset. FIGS. 18A and 18B respectively depict putter head assemblies 4A and 4B having different offset distance characteristics. The putter head assembly 4A of FIG. 18A uses the shaft connector 16A of FIG. 18A with the comparatively small offset between the shaft connector's upper member 68 and lower member 70. This produces a comparatively small offset distance "Off-A" between the putter head's front face 20 and the putter shaft 6. The putter head assembly 4B of FIG. 18B uses the shaft connector 16B of FIG. 17B with the comparatively large offset between the shaft connector's upper member 68 and lower member 70. This produces a comparatively large offset distance "Off-B" between the putter head's front face 20 and the putter shaft 6.

The golf putter head assembly kit 106 of FIG. 12 may be used to implement a unique golf putter assembly method for assembling the golf putter 2. The method may include, in no particular order: (1) selecting one of the putter heads 10 from the set(s) 110 of putter heads of the assembly kit 106, (2) selecting one of the intermediate connectors 14 from the set(s) 112 of intermediate connectors of the assembly kit according to a desired head balance characteristic, (3) selecting one of the removable fasteners 18 from the set(s) 114 of intermediate fasteners of the assembly kit according to the length of the selected intermediate connector, and (4) selecting one of the shaft connectors 16 from the set(s) 116 of shaft connectors of the assembly kit according to desired lie angle and a desired offset distance between the front face of the putter head and the putter shaft. The above-described components selected from the golf head assembly kit 106 can then be assembled to produce the putter head assembly 4. This may be accomplished by interconnecting the selected intermediate connector 14 to the selected shaft connector 16 to form the two-part hosel 12, and mounting the two-part hosel to the selected putter head 10 using the selected removable fastener. Either prior or following the mounting of the two-part hosel 12 to the putter head 10 to complete the putter head assembly 4, the putter shaft 6 may be selected and mounted to the two-part hosel to complete the putter 2.

Accordingly, embodiments of a configurable golf putter, a golf putter assembly kit, and a golf putter assembly method have been disclosed. Reference in the present disclosure to an "embodiment" means that a particular feature, structure or characteristic described in connection with the embodiment may be included in at least one embodiment of the disclosed device. Thus, the appearances of the term "embodiment" in various places throughout the specification are not necessarily all referring to the same embodiment.

For purposes of explanation, specific configurations and details have been set forth herein in order to provide a thorough understanding of the present disclosure. However, it will be apparent to one of ordinary skill in the art that embodiments of the disclosure may be practiced without the specific details presented herein. Furthermore, well-known features may have been omitted or simplified in order not to obscure the disclosed subject matter. Various examples were given throughout this description. These examples are merely descriptions of specific embodiments of the disclosure. The scope of the subject matter set forth in the appended claims is not limited to the examples given.

As used in this application, the terms such as "upper," "lower," "top," "bottom," "vertical," "vertically," "lateral," "laterally," "inner," "outer," "outward," "inward," "front," "frontward," "forward," "rear," "rearward," "upwardly," "downwardly," "inside," "outside," "interior," "exterior," and other orientational descriptors are intended to facilitate the description of the example embodiments of the present disclosure, and are not intended to limit the structure of the example embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments. Terms of rough approximation, such as "generally," are understood by those of ordinary skill to refer to a characteristic or feature of that bears resemblance to something, such that it is reasonable to draw a comparison to facilitate understanding, without requiring that the characteristic or feature be exactly the same, or even substantially the same, as the thing to which it is compared.

Although various embodiments have been described, it should be apparent that many variations and alternative embodiments could be implemented in accordance with the inventive concepts disclosed herein. It will therefore be understood that the invention is not to be in any way limited except in accordance with the spirit of the appended claims and their equivalents.

What is claimed is:

1. A golf putter head assembly, comprising:

a putter head;

a two-part hosel detachably mounted to the putter head by way of a single removable fastener;

the putter head comprising a front face, a back, a toe, a heel, a sole, and a crown;

the front face and the back of the putter head being offset from each other in a putting stroke direction, the toe and the heel of the putter head being offset from each other in a direction that is transverse to the putting stroke direction, and the sole and the crown of the putter head being offset from each other in a vertical direction;

the putter head further comprising a through-bore extending from an upper opening thereof formed in the crown of the putter head to a lower opening thereof formed in the sole of the putter head, the putter head through-bore being disposed closer to the heel of the putter head than the toe of the putter head;

the two-part hosel comprising a lower intermediate connector and an upper shaft connector detachably connected to each other;

the intermediate connector being configured as a substantially straight tube-like structure having a lower end, an upper end, and a through-bore extending from a lower opening thereof formed in the lower end of the intermediate connector and an upper opening thereof formed in the upper end of the intermediate connector, the lower end of the intermediate connector being removably disposed within the upper opening of the putter head, with the intermediate connector through-bore being substantially in axial alignment with the putter head through-bore;

the shaft connector comprising a lower member configured as a substantially straight tube-like structure, an upper member configured as a substantially straight tube-like structure, and an intermediate member configured as a transverse support interconnecting the lower member and the upper member in mutual offset relationship in the putting stroke direction;

the lower member of the shaft connector comprising an upper end connected to the intermediate member, a lower end removably disposed within the upper opening of the intermediate connector, and a blind bore opening at the lower end of the lower member, the blind bore being substantially in axial alignment with the through-bore of the intermediate connector;

the upper member of the shaft connector comprising a lower end connected to the intermediate member, an upper end, and a blind bore opening at the upper end of the upper member that is sized to receive a putter shaft;

the upper member of the shaft connector being angled relative to the lower member of the shaft connector at a selected angle that establishes a lie angle between the putter head and the putter shaft when the putter shaft is mounted to the putter head assembly to form a putter;

the upper member of the shaft connector being offset from the lower member of the shaft connector at a selected distance that establishes an offset distance between the front face of the putter head and the putter shaft when the putter shaft is mounted to the putter head assembly to form a putter;

the intermediate connector having a selected length that establishes a head balance characteristic of a putter formed by joining the golf putter head assembly to the putter shaft;

the removable fastener extending from the lower opening formed in the sole of the putter head to the blind bore of the lower member of the shaft connector; and the removable fastener securing the putter head, the intermediate connector and the shaft connector in a state of fixed mutual attachment.

2. The golf putter head assembly of claim 1, wherein the assembly comprises a set of two or more interchangeable versions of the putter head, each putter head having a unique configuration that differs from the configuration of any other version of the putter head in the set, exclusive of duplicates and spares.

3. The golf putter head assembly of claim 1, wherein the assembly comprises a set of two or more interchangeable versions of the intermediate connector, each intermediate connector extending upwardly from the putter head at the same angle when mounted thereto, each intermediate connector having a unique length that differs from the length of any other version of the intermediate connector in the set, exclusive of duplicates and spares.

4. The golf putter head assembly of claim 3, wherein the assembly comprises a set of two or more interchangeable versions of the removable fastener, each removable fastener having a unique length that differs from the length of any other version of the removable fastener in the set, exclusive of duplicates and spares, and is compatible for use with one of the intermediate connectors based on the length of that intermediate connector.

5. The golf putter head assembly of claim 3, wherein each intermediate connector extends substantially vertically upwardly from the putter head when mounted thereto.

6. The golf putter head assembly of claim 1, wherein the assembly comprises a set of two or more interchangeable versions of the shaft connector, each shaft connector's lower member extending upwardly from the intermediate connector at the same angle when mounted thereto, each shaft connector's upper member forming a unique angle with the shaft connector's lower member that differs from the angle of the upper member of any other version of the intermediate connector in the set, exclusive of duplicates and spares.

7. The golf putter head assembly of claim 6, wherein the lower member of each shaft connector extends substantially vertically upwardly from the intermediate connector in axial alignment therewith.

8. The golf putter head assembly of claim 1, wherein the assembly comprises:

a set of two or more interchangeable versions of the putter head, each putter head having a unique configuration that differs from the configuration of any other version of the putter head in the putter head set, exclusive of duplicates and spares;

a set of two or more interchangeable versions of the intermediate connector, each intermediate connector extending upwardly from the putter head at the same angle when mounted thereto, each intermediate connector having a unique length that differs from the length of any other version of the intermediate connector in the intermediate connector set, exclusive of duplicates and spares;

a set of two or more interchangeable versions of the removable fastener, each removable fastener having a unique length that differs from the length of any other version of the removable fastener in the removable fastener set, exclusive of duplicates and spares, and is compatible for use with one of the intermediate connectors based on the length of that intermediate connector; and a set of two or more interchangeable versions of the shaft connector, each shaft connector's lower member extending upwardly from the intermediate connector at the same angle when mounted thereto, each shaft connector's upper member forming a unique angle with the shaft connector's lower member that differs from the angle of the upper member of any other version of the shaft connector in the shaft connector set, exclusive of duplicates and spares.

9. The golf putter head assembly of claim 1, wherein the intermediate connector extends substantially vertically upwardly from the putter head.

10. The golf putter head assembly of claim 1, wherein the lower member of the shaft connector extends substantially vertically upwardly from the intermediate connector in axial alignment therewith.

11. The golf putter head assembly of claim 1, wherein the intermediate connector and the putter head are joined together by a non-rotatable interconnection that prevents rotation of the intermediate connector relative to the putter head.

12. The golf putter head assembly of claim 11, wherein the non-rotatable interconnection between the intermediate connector and the putter head comprises the lower end of the intermediate connector and the upper opening of the putter head being rotatably indexed to each other.

13. The golf putter head assembly of claim 12, wherein the lower end of the intermediate connector is formed with an indexing pin that includes a non-circular indexing profile, and wherein the upper opening of the putter head is formed with an indexing slot having a matching non-circular indexing profile.

14. The golf putter head assembly of claim 13, wherein the intermediate connector comprises a circular profile above and below the indexing pin.

15. The golf putter head assembly of claim 1, wherein the shaft connector and the intermediate connector are joined together by a non-rotatable interconnection that prevents rotation of the shaft connector relative to the intermediate connector.

16. The golf putter head assembly of claim 15, wherein the non-rotatable interconnection between the shaft connector and the intermediate connector comprises the lower end of the shaft connector's lower member and the upper opening of the intermediate connector being rotatably indexed to each other.

17. The golf putter head assembly of claim 16, wherein the lower end of the shaft connector's lower member is formed with an indexing pin that includes an non-circular indexing profile, and wherein the upper opening of the intermediate connector is formed with an indexing slot having a matching non-circular indexing profile.

18. The golf putter head assembly of claim 17, wherein the shaft connector's lower member comprises a circular profile above and below the indexing pin.

19. A golf putter head assembly kit for assembling a golf putter head assembly:

(1) the golf putter head assembly comprising:

a putter head;

a two-part hosel detachably mounted to the putter head by way of a single removable fastener;

the putter head comprising a front face, a back, a toe, a heel, a sole, and a crown;

the front face and the back of the putter head being offset from each other in a putting stroke direction, the toe and the heel of the putter head being offset from each other in a direction that is transverse to the putting stroke direction, and the sole and the crown of the putter head being offset from each other in a vertical direction;

the putter head further comprising a through-bore extending from an upper opening thereof formed in the crown of the putter head to a lower opening thereof formed in the sole of the putter head, the through-bore being disposed closer to the heel of the putter head than the toe of the putter head;

the two-part hosel comprising a lower intermediate connector and an upper shaft connector detachably connected to each other;

the intermediate connector being configured as a substantially straight tube-like structure having a lower end, an upper end, and a through-bore extending from a lower opening thereof formed in the lower end of the intermediate connector and an upper opening thereof formed in the upper end of the intermediate connector, the lower end of the intermediate connector being removably disposed within the upper opening of the putter head, with the intermediate connector through-bore being substantially in axial alignment with the putter head through-bore;

the shaft connector comprising a lower member configured as a substantially straight tube-like structure, an upper member configured as a substantially straight tube-like structure, and an intermediate member configured as a transverse support interconnecting the lower member and the upper member in mutual offset relationship in the putting stroke direction;

the lower member of the shaft connector comprising an upper end connected to the intermediate member, a lower end removably disposed within the upper opening of the intermediate connector, and a blind bore opening at the lower end of the lower member, the blind bore being substantially in axial alignment with the through-bore of the intermediate connector;

the upper member of the shaft connector comprising a lower end connected to the intermediate member, an upper end, and a blind bore opening at the upper end of the upper member that is sized to receive a putter shaft;

the upper member of the shaft connector being angled relative to the lower member of the shaft connector at a selected angle that establishes a lie angle between the putter head and the putter shaft when the putter shaft is mounted to the putter head assembly to form a putter;

the upper member of the shaft connector being offset from the lower member of the shaft connector at a selected distance that establishes an offset distance between the front face of the putter head and the putter shaft when the putter shaft is mounted to the putter head assembly to form a putter;

the intermediate connector having a selected length that establishes a head balance characteristic of a putter formed by joining the golf putter head assembly to the putter shaft;

the removable fastener extending from the lower opening formed in the sole of the putter head to the blind bore of the lower member of the shaft connector; and the removable fastener securing the putter head, the intermediate connector and the shaft connector in a state of fixed mutual attachment;

(2) the golf putter head assembly kit comprising:

a set of two or more interchangeable versions of the putter head, each putter head having a unique configuration that differs from the configuration of any other version of the putter head in the putter head set, excluding duplicates and spares;

a set of two or more interchangeable versions of the intermediate connector, each intermediate connector extending upwardly from the putter head at the same angle when mounted thereto, each intermediate connector having a unique length that differs from the length of any other version of the intermediate connector in the intermediate connector set, excluding duplicates and spares;

a set of two or more interchangeable versions of the removable fastener, each removable fastener having a unique length that differs from the length of any other version of the removable fastener in the removable fastener set, excluding duplicates and spares, and is compatible for use with one of the intermediate connectors based on the length of that intermediate connector; and a set of two or more interchangeable versions of the shaft connector, each shaft connector's lower member extending upwardly from the intermediate connector at the same angle when mounted thereto, each shaft connector's upper member forming a unique angle with the shaft connector's lower member that differs from the angle of the upper member of any other version of the shaft connector in the shaft connector set, excluding duplicates and spares.

20. A golf putter assembly method for assembling a golf putter from a golf putter head assembly kit:

(1) the golf putter head assembly comprising:

a putter head;

a two-part hosel detachably mounted to the putter head by way of a single removable fastener;

the putter head comprising a front face, a back, a toe, a heel, a sole, and a crown;

the front face and the back of the putter head being offset from each other in a putting stroke direction, the toe and the heel of the putter head being offset from each other in a direction that is transverse to the putting stroke direction, and the sole and the crown of the putter head being offset from each other in a vertical direction;

the putter head further comprising a through-bore extending from an upper opening thereof formed in the crown of the putter head to a lower opening thereof formed in the sole of the putter head, the through-bore being disposed closer to the heel of the putter head than the toe of the putter head;

the two-part hosel comprising a lower intermediate connector and an upper shaft connector detachably connected to each other;

the intermediate connector being configured as a substantially straight tube-like structure having a lower end, an upper end, and a through-bore extending from a lower opening thereof formed in the lower end of the intermediate connector and an upper opening thereof formed in the upper end of the intermediate connector, the lower end of the intermediate connector being removably disposed within the upper opening of the putter head, with the intermediate connector through-bore being substantially in axial alignment with the putter head through-bore;

the shaft connector comprising a lower member configured as a substantially straight tube-like structure, an upper member configured as a substantially straight tube-like structure, and an intermediate member configured as a transverse support interconnecting the lower member and the upper member in mutual offset relationship in the putting stroke direction;

the lower member of the shaft connector comprising an upper end connected to the intermediate member, a lower end removably disposed within the upper opening of the intermediate connector, and a blind bore opening at the lower end of the lower member, the blind bore being substantially in axial alignment with the through-bore of the intermediate connector;

the upper member of the shaft connector comprising a lower end connected to the intermediate member, an upper end, and a blind bore opening at the upper end of the upper member that is sized to receive a putter shaft;

the upper member of the shaft connector being angled relative to the lower member of the shaft connector at a selected angle that establishes a lie angle between the putter head and the putter shaft when the putter shaft is mounted to the putter head assembly to form a putter;

the upper member of the shaft connector being offset from the lower member of the shaft connector at a selected distance that establishes an offset distance between the front face of the putter head and the putter shaft when the putter shaft is mounted to the putter head assembly to form a putter;

the intermediate connector having a selected length that establishes a head balance characteristic of a putter formed by joining the golf putter head assembly to the putter shaft;

the removable fastener extending from the lower opening formed in the sole of the putter head to the blind bore of the lower member of the shaft connector; and the removable fastener securing the putter head, the intermediate connector and the shaft connector in a state of fixed mutual attachment;

(2) the golf putter head assembly kit comprising:

a set of two or more interchangeable versions of the putter head, each putter head having a unique configuration that differs from the configuration of any other version of the putter head in the putter head set, excluding duplicates and spares;

a set of two or more interchangeable versions of the intermediate connector, each intermediate connector extending upwardly from the putter head at the same angle when mounted thereto, each intermediate connector having a unique length that differs from the length of any other version of the intermediate connector in the intermediate connector set, excluding duplicates and spares;

a set of two or more interchangeable versions of the removable fastener, each removable fastener having a unique length that differs from the length of any other version of the removable fastener in the removable fastener set, excluding duplicates and spares, and is compatible for use with one of the intermediate connectors based on the length of that intermediate connector; and a set of two or more interchangeable versions of the shaft connector, each shaft connector's lower member extending upwardly from the intermediate connector at the same angle when mounted thereto, each shaft connector's upper member forming a unique angle with the shaft connector's lower member that differs from the angle of the upper member of any other version of the shaft connector in the shaft connector set, excluding duplicates and spares;

(3) the method comprising, in any order:

selecting one of the putter heads according to a desired putter head configuration;

selecting one of the intermediate connectors according to a desired head balance characteristic;

selecting one of the shaft connectors according to a desired lie angle and a desired offset distance between the front face of the putter head and the putter shaft;

selecting a putter shaft;

assembling the golf putter head assembly by interconnecting the selected intermediate connector to the selected shaft connector to form the two-part hosel, and mounting the two-part hosel to the putter head using the removable fastener; and prior to or after mounting the two-part hosel to the putter head, mounting the selected putter shaft to the two-part hosel.

* * * * *